US005720184A

United States Patent [19]

Olsen

[11] Patent Number: 5,720,184

[45] Date of Patent: Feb. 24, 1998

[54] LOW PRESSURE REFRIGERANT RECOVERY RECYCLE MACHINE

[75] Inventor: Wendell C. Olsen, Canby, Oreg.

[73] Assignee: Endeavor Enterprises, Inc., Canby, Oreg.

[21] Appl. No.: 373,372

[22] Filed: Jan. 17, 1995

[51] Int. Cl.[6] ..... F25B 45/00

[52] U.S. Cl. ..... 62/292; 62/149

[58] Field of Search ..... 62/77, 85, 149, 62/292, 475

[56] References Cited

U.S. PATENT DOCUMENTS

| | | | |
|---|---|---|---|
| 5,077,984 | 1/1992 | Jance | 62/292 |
| 5,101,637 | 4/1992 | Daily | 62/292 |
| 5,189,881 | 3/1993 | Miles | 62/292 |
| 5,201,188 | 4/1993 | Sakuma | 62/292 |

*Primary Examiner*—John M. Sollecito

[57] ABSTRACT

A machine and co-operating apparatus with method to variably adjust delivery pressure reducing apparatus to complement removal of the different types of refrigerant from disabled refrigeration units in liquid or vapor form. Recovery tank, and system are vacumn evacuated by recovery system condensing unit before recovery is started by freeze chilling recovery tank removably enclosed within separate refrigerant supplied refrigeration unit evaporator cabinet to establish wide temperature difference between disabled refrigeration unit, and recovery tank utilizing co-operating pressure reducing apparatus to enable cool low pressure flow of liquid refrigerant to said tank. Same apparatus allows disabled refrigeration unit's supply pressure of refrigerant to remain stabilized throughout recovery procedure. Said pressure maintenance prevents freezing of water cooled condensers and chiller evaporators. Same pressure reducing apparatus control of supply pressure liquid refrigerant enables vaporized cooling with re-liquification upon entry to refrigerant conduit, and apparatus supplying refrigerant to recovery tank. Machine and co-operating apparatus further configured to access refrigerant vapor from same supply pressure controlling apparatus to supply machine's recovery system condenser unit that condenses vapor to a liquid. Then condensing unit's pressure reducing outlet apparatus provides vaporized refrigerant that cools and re-liquifies upon entering refrigerant conduit to recovery tank. Machine further configured to separate oil during recovery and distilling with intermittent air purge from tank gauge manifold optional. Removed oil is replaced, and refrigerant further distilled during recycling procedure. Machine is portable, and freezer unit remotely placeable if desired.

6 Claims, 6 Drawing Sheets

LOW PRESSURE REFRIGERANT RECOVERY RECYCLE MACHINE

FIELD OF THE INVENTION

The invention relates generally to refrigerant recovery devices that employ separate cooling units to create a temperature difference between a disabled refrigeration unit being serviced and the recovery system to promote flow of refrigerant from the unit being serviced to the recovery system storage tank.

The present invention has separate cooling unit that accomplishes this, and additionally incorporates apparatus to control pressure, and temperature of the refrigerant being removed above freezing within the unit being serviced. The pressure controlling apparatus then reduces pressure and temperature at it's outlet, and in the process accomplishes reliquification of the refrigerant in transit to the receiving storage tank. This process is accomplished in both the liquid, and vapor phase recovery procedures.

SUMMARY OF THE INVENTION

A refrigerant recovery, recycle apparatus with method to remove the various types of CFC,HCFC,and HFC refrigerants from disabled refrigeration units in liquid or vapor form. In comparison with prior, similar methods that remove refrigerant in liquid or vapor form without regard to controlling the rapid pressure reduction and the freezing of the refrigerant within the disabled refrigeration unit, caused two disadvantages. 1.Water cooled condensers, and water chiller evaporators could freeze and cause tubular damage, or 2. Refrigerant removal had to be interrupted to pump refrigerant vapor back into the disabled refrigeration unit to force refrigerant liquid to flow, and at the same time create a reduced pressure in recovery tank to allow this flow under all recovery conditions present. The present invention provides: 1. Simultaneus vacumn evacuation of the recovery system and tank with recovery system compressor/condenser unit. and cooling with separate refrigerant cooling means. 2. Cooling of tank continues as liquid refrigerant recovery is accessed from disabled refrigeration unit and passed through a valved gauge manifold mounted expansion valve that vaporizes the liquid refrigerant (this function causes the expansion valve to control the pressure and temperature above freezing within the disabled refrigeration unit) that flows in vapor form to the Oil Separator wherein oil deposits out of solution from the vaporized refrigerant to flow to the separator bottom as the refrigerant vapor flows from the separator outlet to the operating liquid refrigerant pump inlet as a cooled, liquid saturated vapor. The Liquid Refrigerant pump then completes the liquification of the refrigerant as it enters the adjustable expansion valve wherein the supply pressure is maintained, and the adjustable expansion valve vaporizes, and cools the refrigerant supplied to the replaceable core filter drier wherein low pressure, and temperature liquification occurs at its outlet. The liquid refrigerant then flows to the disposable filter drier inlet wherein added vaporization with cooling occurs with liquification at the outlet. Liquid refrigerant continues reduced pressure/temperature flow through bypass Tee run (Tee branch supplies vapor compressor suction service valve that is now front seated (closed) through flow through stop valve (detours refrigerant in vapor recovery phase) to and through return (from vapor compressor expansion valve outlet) bypass Tee run to and through liquid refrigerant pump unit liquid moisture monitoring sight glass to Recovery tank valved gauge manifold supply port, and through hose to Recovery tank liquid valve to complete liquid removal.

Upon removal of refrigerant liquid. The liquid refrigerant pump is stopped, and the flow through stop valve is closed for bypassing refrigerant vapor to the vapor compressor suction service valve that is opened, and the compressor discharge service valve is also opened to allow refrigerant flow to the outlet expansion valve supplying refrigerant to the liquid refrigerant pump return bypass Tee branch. The valve to the gauged manifold expansion valve is closed, and the right side full flow control valve is opened for vapor flow from the disabled refrigeration unit. The Vapor Compressor is operated with condensing taking place within the fan cooled condenser with liquid refrigerant supplied to the outlet expansion valve. The expansion valve vaporizes, the refrigerant that cools and liquifies within the hose supplying refrigerant to the liquid refrigerant pump unit bypass return Tee branch, and through said unit's liquid/moisture indicator sight glass to be supplied to recovery tank valved gauge manifold, and outlet port to tank liquid supply port. When the refrigerant vapor supply is exhausted within the disabled refrigeration unit; The Vapor compressor condensing unit continues to operate until said unit's low pressure control stops same under vacumn setting.

The present invention is configured to replace oil removed prior to the refrigerant recycling procedure.

The present invention provides for moisture and contaminant removal during the recovery and recycle procedures with vacumn evacuation prior to the latter after pressurizing for leak check.

The present invention provides 5 separate Evaporator/Condenser assemblies to accomplish the vaporization, cooling, and re-liquification within recovery system apparatus, conduit and hose circuits to deliver low pressure liquid refrigerant. The assemblies non-obviously small in form and do not compare in size and design to conventional evaporators and condensers in normal system art design or operation configuration demand, and said units not combined into one functioning assembly as is the assemblies of the invention.

DETAILED DESCRIPTION OF THE INVENTION

Figure 1:
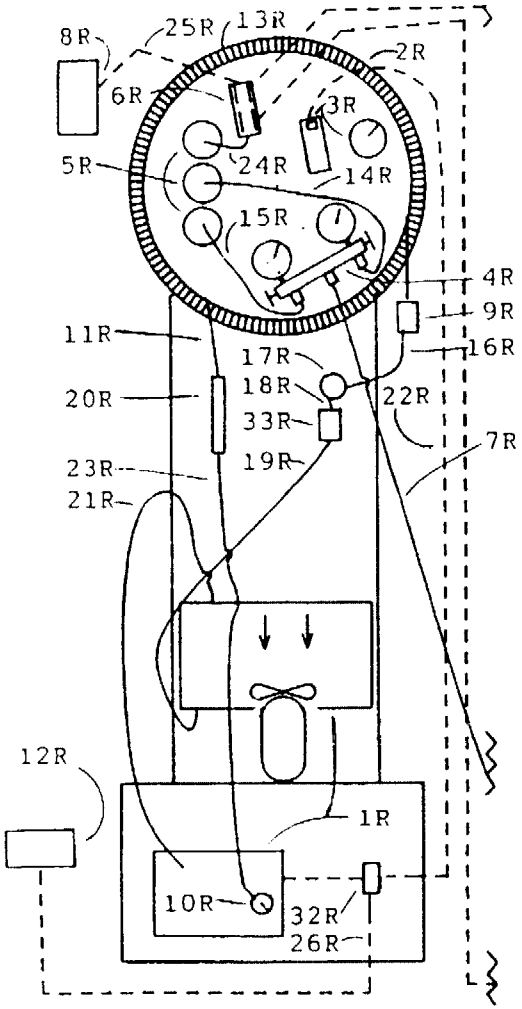

FIG. 1 recovery tank (not Shown) freezer unit includes an insulated circular hinged top (not shown) enclosing evaporator cabinet cabinet 2R with a condensing unit 1R. The removably enclosed recovery tank has inlet valve ports (not shown) connected to two valve gauge manifold 4R outlet ports through hoses 14R and 15R that emerge through rubber grommet ports 5R of the hinged top, and gauge manifold 4R inlet port connected by inlet hose 7R to outlet port of liquid refrigerant pump unit sight glass 13L. (see FIG. 2)

Enclosing evaporator cabinet 2R has insulation (shaded lines) enclosed between it and evaporator cabinet coil assembly 13R. Evaporator cabinet 2R hinged top has a recovery tank float switch (not shown) controlled power outlet 6R connected to power outlet 8R by power cord 25R, and also connected to the recover tank float switch with a power cord 24R that emerges through rubber grommet port 5R. The float switched outlet 6R functions to stop liquid refrigerant pump 6L (see FIG. 2) or vapor compressor unit 2V (see FIG. 3) when recovery tank level is filled to 80 percent of capacity. Enclosing evaporator cabinet 2R hinged top has a remote sensing bulb thermostat 3R connected by power cord 22R to condenser 32R unit power switch 1R through power cord 26R to power outlet 12R.

The freezer compressor 1R has discharge refrigerant conduit 21R run to fan type condenser 32R radiator that has outlet refrigerant conduit 19R connected to and through filter drier 32R to refrigerant conduit 18R connected to sight glass 17R with conduit 16R connected to inlet of adjustable expansion valve 9R outlet is connected to inlet of freezer coil. The freezer outlet conduit 11R is connected to inlet of filter drier 20R, and conduit 23R runs from outlet of said filter drier to suction inlet fitting to compressor 1R which is adjacent to low side pressure gauge 10R. Condenser 1R, and enclosing evaporator cabinet 2R have a base mounting plate to support same at base with a brace tube from evaporator cabinet 2R side to top of compressor 1R.

Figure 2:
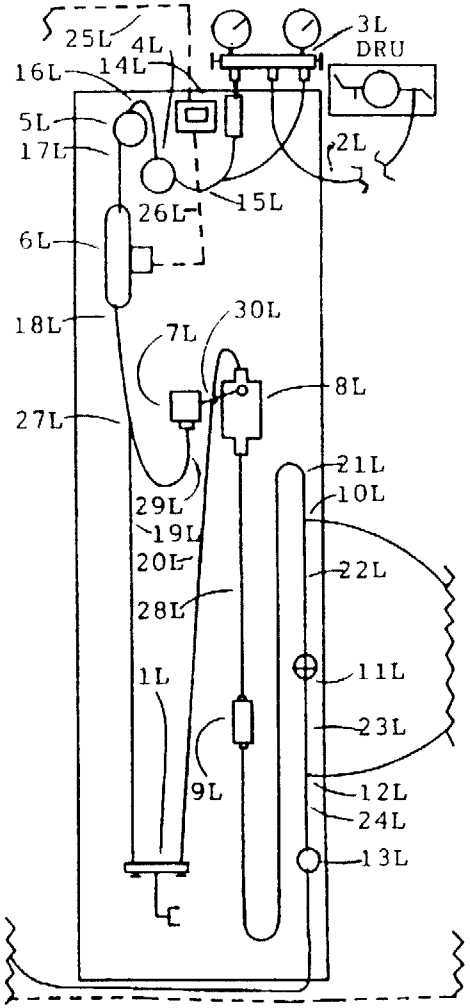

FIG. 2 shows the liquid refrigerant pump unit connected to a disabled refrigeration unit DRU discharge service valve access port through hose 2L to the inlet port of a two valve gauge manifold 3L. The left gauge valve port of same manifold has an expansion valve 3L connected in series with a hose to tee 3L inlet, and right gauge valve port connected to tee 3L branch inlet hose. Oil separator 4L is connected to the outlet conduit of conduit tee 3L and a first sight glass 5L is connected to the outlet conduit 16L of the oil separator 4L with the outlet conduit 17L connected to the inlet port of liquid refrigerant pump 6L. The outlet of the liquid refrigerant pump 6L is connected by conduit 18L to tee 27L ( two valve gauge manifold 1L serves as high and low side pressure monitor during recovery phases) Tee 27L outlet connected by conduit 29L to an adjustable expansion valve 7L which is connected by conduit 30L to the inlet port of a replaceable core filter drier 8L having a top access port connected to the two valve gauge manifold 1L low pressure valve port via conduit 20L. Replaceable core filter drier 8L outlet port is connected with conduit 28L to inlet port of a disposable filter drier 9L having an outlet port connected by conduit 21L to tee 10L inlet with said tee 10L Branch connected by hose 1V to suction service valve of vapor compressor 2V. (see FIG. 3) Tee 10L outlet connected by conduit 22L to inlet port of flow through stop valve 11L with an outlet port connected by conduit 23L to tee 12L inlet with a branch connected by hose 6V to vapor compresSor/condenser unit expansion valve 5V outlet.

Figure 3:
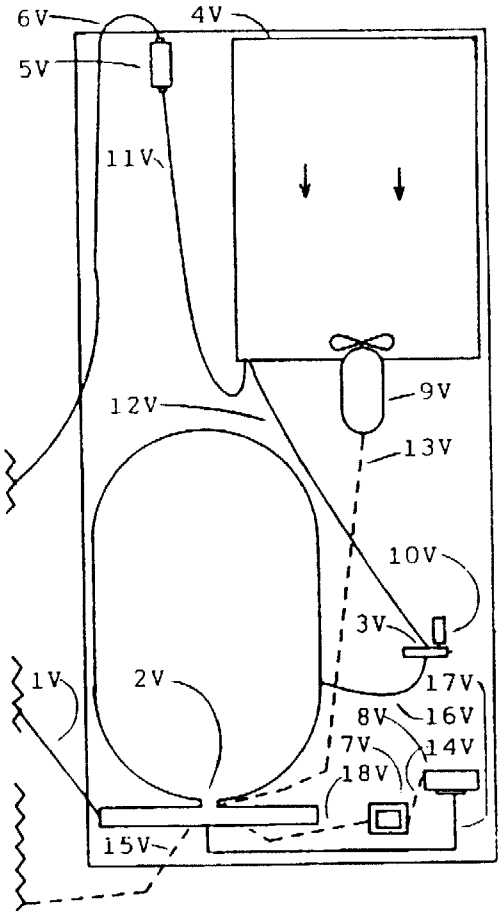

Tee 12L connected by conduit 24L to inlet port of a second moisture sensing sight glass 13L having an outlet port connected by hose 7R to inlet port 4R of two valve gauge manifold of recovery tank freezer unit (see FIG. 1) The liquid refrigerant pump 6L is electrically connected to power switch 14L which is electrically connected to freezer unit recovery tank float switch controlled power outlet 6R (see FIG. 1) The two valve gauge manifold 3L, and power switch 14 L are secured to the unit base plate with liquid refrigerant pump 6L. FIG. 3 shows liquid refrigerant pump tee 10L branch outlet connected to vapor compressor 2V suction service valve inlet port with hose 1V. (see FIG. 2) Discharge service valve 3V connected to compressor 2V outlet conduit 16V, and magnetic check valve 10V connected to discharge service valve 3V access port. Discharge service valve 3V outlet conduit. 12V connected to inlet tube of condenser 4V, and outlet tube 11V of said connected to inlet port of compressor/condensing unit expansion valve 5V with outlet port of same connected to liquid refrigerant pump unit tee 12L branch inlet with hose 6V (see FIG. 2)

Figure 3A:
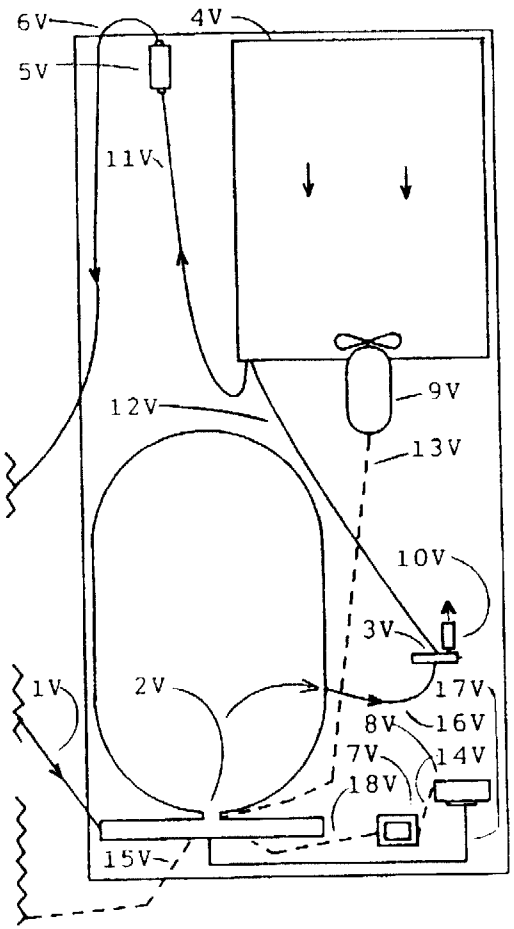
Figure 2A:
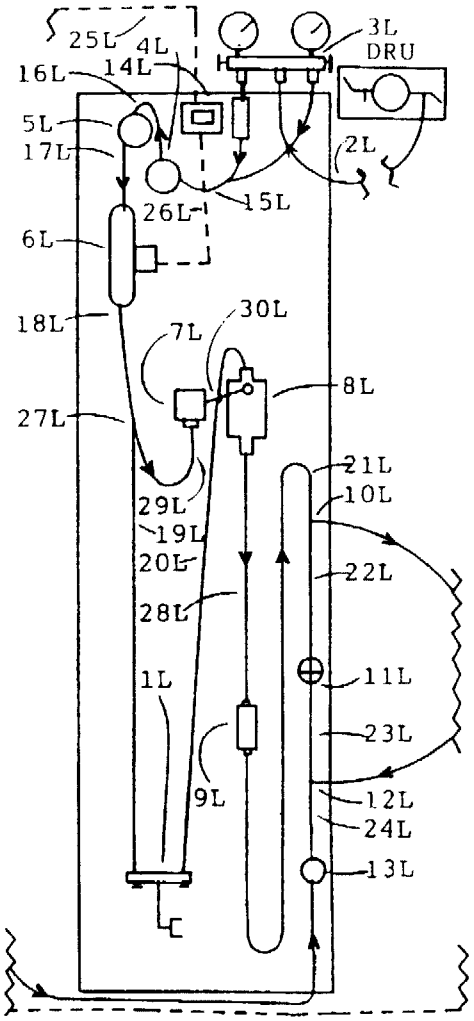
Figure 1A:
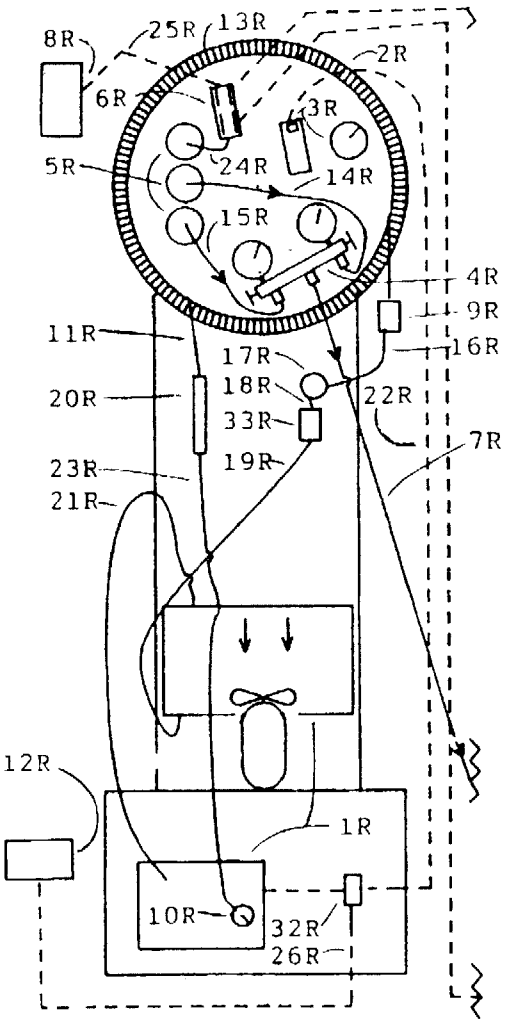

Compressor 2V suction service valve ports is connected to the low pressure control 8V diaphram port with conduit 17V. Compressor 2V and condenser fan motor 9V connected to power switch 7V with electrical cord 18V, and low pressure control 8V electrically connected to and through power switch 7V with electrical cord 14V,and compressor 2V electrically connected to freezer unit recovery tank float switch controlled power outlet 6R with power cord 15V. (see FIGS. 1 & 3) Compressor 2V is bolt mounted to the support plate, and condenser fan motor 9V is similarly mounted to the same plate. Condenser 4V, discharge service valve 3V, power switch 7V, and low pressure control 8V are each secured to the support plate with screws. (FIGS. 1*a*, 2*a*, 3*a*)

To prepare the refrigerant recovery system for the recovery procedure. The freezer unit is operated to cool the evaporator cabinet coil 13R to zero degrees fahrenheit while simultaneously operating vapor compressor 2V to evacuate the recovery tank with conduit and hose circuits connecting FIGS. 1*a*, 2*a*, and 3*a*. Upon completion of vacuum evacuation procedure. The vapor compressor 2V is stopped, and the suction service valve is front seated, and the previously front seated discharge service valve 3V service port connected magnetic check valve 10V outlet port is capped (see FIG. 3*a*) The two valve gauge manifold 1L gauge valves to remain closed with inlet port hose plugged. (see FIG. 2*a*) The recovery tank freezer unit 1R to remain in operation to prepare for FIGS. 1*b*, 2*b*, and 3*b* liquid refrigerant recovery procedure. (See FIGS. 1*b*, 2*b*, 3*b*)

After vacuum evacuation of the recovery system with cooling of the freezer unit recovery tank evaporator cabinet to zero degrees fahrenhiet has been intially accomplished, recovery of the liquid refrigerant from the disabled refrigeration unit under repair proceeds as described below. The DRU Disabled refrigeration unit discharge service valve is opened to start flow of liquid refrigerant to center inlet port of two valve gauge manifold 3L, then, then through left valve port expansion valve, to tee 3L, to oil separator 4L, through sight glass 5L, and conduit 17L. Refrigerant then flows through liquid refrigerant pump 6L, conduit 18L, tee 27L, continuing through conduit 29L, adjustable expansion valve 7L, conduit 30L, insulated replaceable core filter drier 8L (vaporized refrigerant liquifies within drier shell), conduit 28L, disposable filter drier 9L, (refrigerant again vaporizes & liquifies in second drier shell) outlet conduit 21L, tee 10L, conduit 22L, stop valve 11L, conduit 23L, downstream tee 12L, conduit 24L, sight glass 13L, outlet hose 7R (see FIG. 1*b*) to two valve gauge manifold 4R center inlet port, with flow directed through right gauge valve outlet port and hose 14R through grommet 5R to recovery tank (not shown) liquid valve port. When liquid refrigerant is not visible in sight glasses 5L and 13L, the liquid refrigerant pump 6L is stopped, and flow through stop valve 11L is closed. Vapor compressor 2V suction service valve, and discharge service valve 3V are then opened in preparation for vaporous refrigerant recovery. Recovery tank pressure & temperature then inspected for chart referenced non-condensables presence. (See FIGS. 1*c*, 2*c*, 3*c*)

Vaporous refrigerant recovery is initiated after closing left valve, and opening right valve of two valve gauge manifold 3L. (see FIG. 2*c*) Vapor compressor/condenser 2V & 4V unit is started (see FIG. 3*c*) and run to receive refrigerant vapor from conduit and hose circuits of liquid refrigerant pump 6L to freezer recovery tank unit 1R & 2R. Refrigerant is supplied by discharge service valve of Disabled refrigeration unit DRU to hose 2L to and through right valve of two valve gauge manifold, tee 3L, conduit 15L, oil separator 4L, conduit 16L, sight glass 5L, conduit 17L, liquid refrigerant pump 6L, conduit 18L, tee 27L, conduit 29L, adjustable expansion valve 7L, conduit 30L, replaceable core filter drier 8L, conduit 28L, disposable filter drier 9L, conduit 21L, tee branch 10L, hose 1V (see FIG. 3C) vapor compressor 2V suction service valve, vapor compressor 2V, conduit 16V, discharge service valve 3V, conduit 12V, conduit 11V, Expansion valve 5V, hose 6V, tee branch 12L, conduit 24L, sight glass 13L, hose 7R, two valve gauge manifold 4R, and right gauge valve outlet port hose 14R to the recovery tank liquid valve port.(not shown) Recovery procedure is then terminated when the vapor compressor is stopped by low pressure control 8V under vacuum. (FIGS. 1*c* & 3*c*) Vapor compressor 2V power switch is shut off, and compressor 2V suction service valve, and discharge service valve 3V are front seated (off). Freezer unit compressor/condenser 1R is stopped and valves of two valve gauge manifold 4R are closed. (see FIGS. 1*d*, 2*d*, 3*d*) After repair of the disabled refrigeration Unit DRU is completed installation of filter driers and system leak check is performed. Refrigerant service hoses are changed as follow for evacuation procedure. A hose is connected to tee 10L branch inlet port mounted expansion valve from repaired disabled refrigeration unit DRU suction service valve (SSV). Two valve guage manifold 3L center port connected hose 2L and right gauge valve connected hose are position switched, one for the other on each respective gauge port.(See FIG. 2D) Two valve gauge manifold 1L (see FIG. 2*d*) center port hose is removed and connected to sight glass #2 13L outlet with the other end of this hose connected to compressor 2V suction service valve inlet port. (see FIGS. 1*d*, 2*d*, 3*d*) Then hose 7R (see FIG. 1*d*) that was removed from sight glass 13L outlet is connected to center port of two valve gauge manifold 1L. (see FIG. 2*d*) The repaired disabled refrigeration unit DRU suction service valve (SSV) is opened for the access of tee 10L branch inlet port mounted expansion valve. Then discharge service valve (DSV) of repaired disabled refrigeration unit DRU is opened to access the inlet hose 2L that is connected to the two valve gauge manifold 3L. Right gauge valve is then opened. (see FIG. 2*d*) The vapor compressor 2V suction service valve is opened to the recovery system. (see FIG. 3*d*)

Evacuation of the disabled refrigeration (repaired) unit is begun with the start of the vapor compressor 2V and proceeds from and through the recovery system shown and is terminated when the vapor compressor 2V low pressure control 8V stops evacuation procedure upon reaching the 20" vacuum set point wherein the power switch 7V is shut off. Vapor compressor 2V suction service valve is closed, and discharge service valve 3V magnetic check valve 10 V is then capped. External vacuum pump hose is then connected to suction service valve port of compressor 2V, and evacuation is then completed with same vacuum pump. (FIGS. 1*e*, 2*e*, 3*e*)

Removed oil is replaced to repaired disabled refrigeration unit DRU prior to refrigerant recycle procedure through the access port provided. The two valve gauge manifold 3L right gauge valve is closed to hose 2L for monitoring discharge service valve (DSV) pressures of the DRU. (FIG. 2*e*) Flow through stop valve 11L is closed to isolate vapor compressor 2V, and condenser 4V from the recovery system. (see FIGS. 2*e*, & 3*e*) The left gauge valve of two valve gauge gauge manifold 1L is closed to isolate adjustable expansion valve 7L, liquid refrigerant pump 6L, sight glass 5L, oil separator 4L, and two valve gauge manifold from recycling conduit and hose circuits, shown by direction of flow arrows to suction service valve (SSV) of repaired disabled refrigeration unit DRU. The suction service valve (SSV) of the repaired disabled refrigeration unit DRU is then opened. Then refrigerant vapor is charged to the repaired disabled refrigeration unit DRU from the left gauge port of two valve manifold 4R, via the connected hose 15R, center port to hose 7R, to two valve gauge manifold 1L (see FIGS. 1*e*, & 2*e*) and conduit 20L, top port of replaceable core filter drier 8L, through conduit 28L, filter drier 9L, conduit 21L, tee branch 10L, and tee branch connected expansion valve to repaired disabled refrigeration unit DRU suction service valve(SSV), with continued vapor charging until vapor pressure is equal in recovery tank and the repaired disabled refrigeration unit. Then the repaired disabled refrigeration unit DRU is started, and the right gauge port valve to hose 14R to two valve gauge manifold 4R is opened to access liquid refrigerant from recovery tank after closing the left valve port of same manifold, and charging of system continues until refrigerant charge is stabilized within the repaired refrigeration system DRU. This unit is stopped after closing of supply valves from recovery tank, and supply hoses & conduit are evacuated of refrigerant. Repaired system suction service and discharge service valves are closed with hoses removed to complete procedure.

PRESENT INVENTION SCHEMATIC LOCATION SPECIFIC DRAWINGS DESCRIPTION

FIG. 1 presents numbered and lettered components itmization that diagrams top view of recovery tank freezer unit with right plane refrigeration conduit, and electrical cord breakaways to separate figures for clarity.

FIG. 2 presents numbered and.lettered components itemization that diagrams top view of liquid refrigerant pump unit with left and right plane refrigeration conduits, and electrical cords breakaways to separate figures for clarity.

FIG. 3 presents numbered and letter component itemization that diagrams top view of vapor compressor condensing unit with left plane refrigeration conduit, and electrical cord breakaways to separate figures for clarity.

Following drawings refrigeration conduit arrows, and electrical cord right angle arrows indicate functions.

FIG. 1*a* presents numbered and lettered components itemization that diagrams top view of recovery tank freezer unit in operation and recovery tank being vacumn evacuated with right plane refrigeration conduit, and electrical cord breakaways separating figures for clarity.

FIG. 2*a* presents numbered and lettered components itemization that diagrams liquid refrigeration pump unit being vacumn evacuated with left and right plane refrigeration conduits and electrical cords breakaway separating figures for clarity.

FIG. 3*a* presents numbered and letterd components itemization that diagrams top view of vapor compressor in operation to vacumn evacuate recovery system only with left plane refrigeration conduits and electrical cord breakaway separating figures for clarity.

Figure 1B:
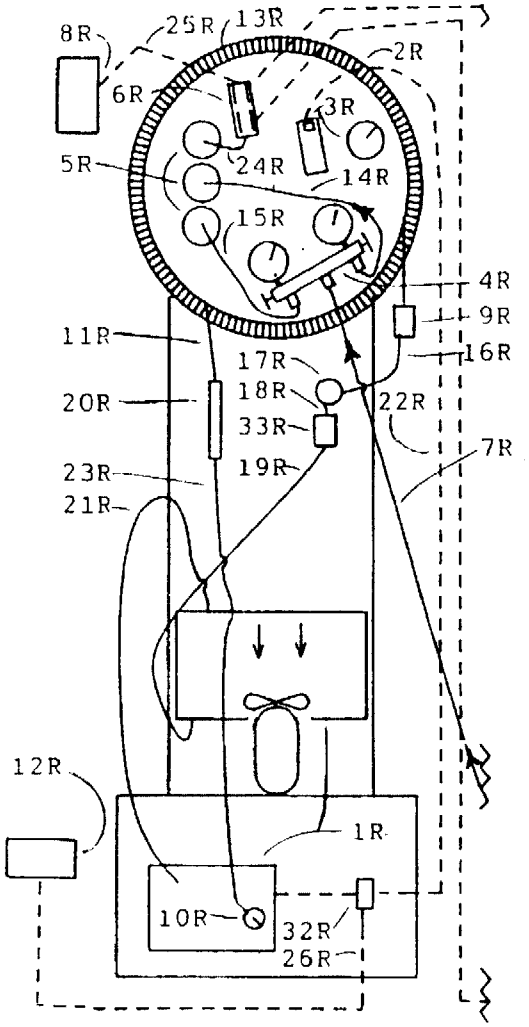

FIG. 1*b* presents numbered and lettered components itemization that diagrams top view of recovery tank freezer unit in operation and recovery tank receiving low pressure liquid refrigerant with right plane refrigeration conduit, and electrical cord breakaways separating figures.

Figure 2B:
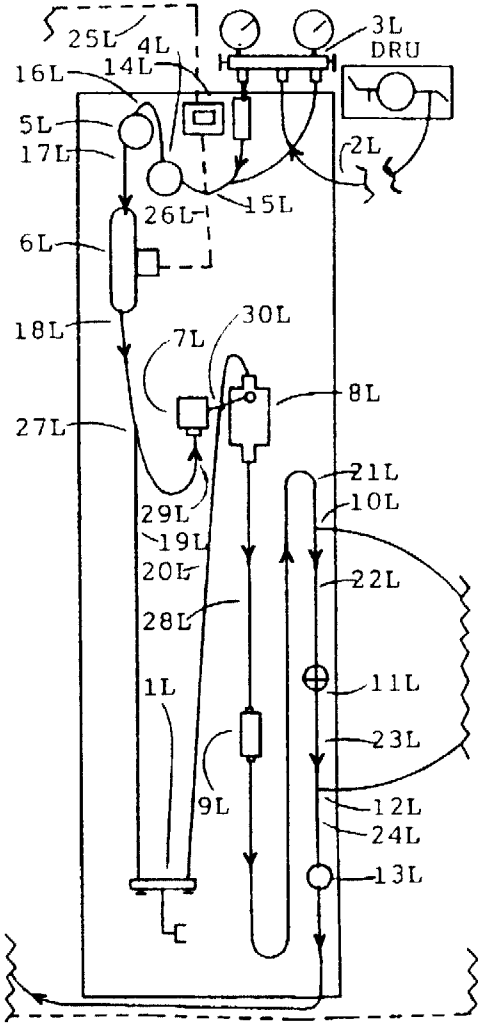

FIG. 2*b* presents numbered and lettered components itemization that diagrams top view of liquid refrigerant pump unit operating to supply low pressure liquid refrigerant to recovery tank (FIG. 1*b*) with left and right plane refrigeration conduits and electrical cords breakaway separating figures for clarity.

Figure 3B:
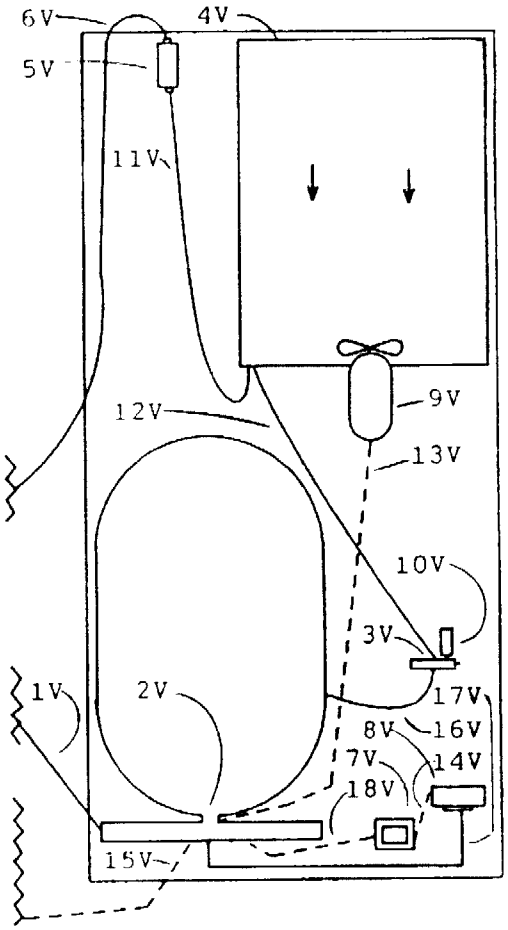

FIG. 3*b* presents numbered and lettered components itemization that diagrams top view of vapor compressor condensing unit in idle phase with left plane refrigerant conduits, and electrical cord breakaway separating figures for clarity.

Figure 1C:
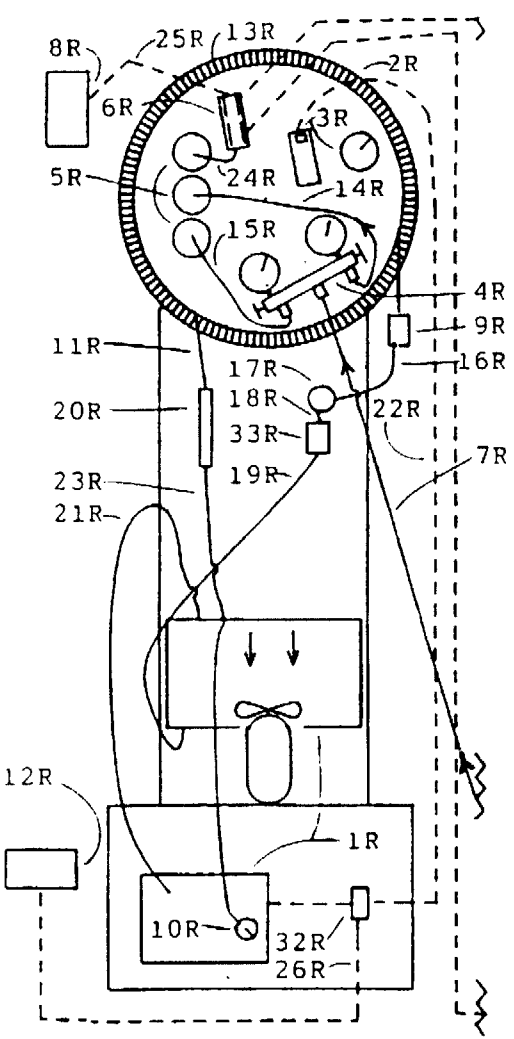

FIG. 1*c* presents numbered and lettered components itemization that diagrams top view of recovery tank freezer unit in operation with recovery tank receiving low pressure liquid refrigerant with right plane refrigerant conduit and electrical cord breakaways separating figures for clarity.

Figure 3C:
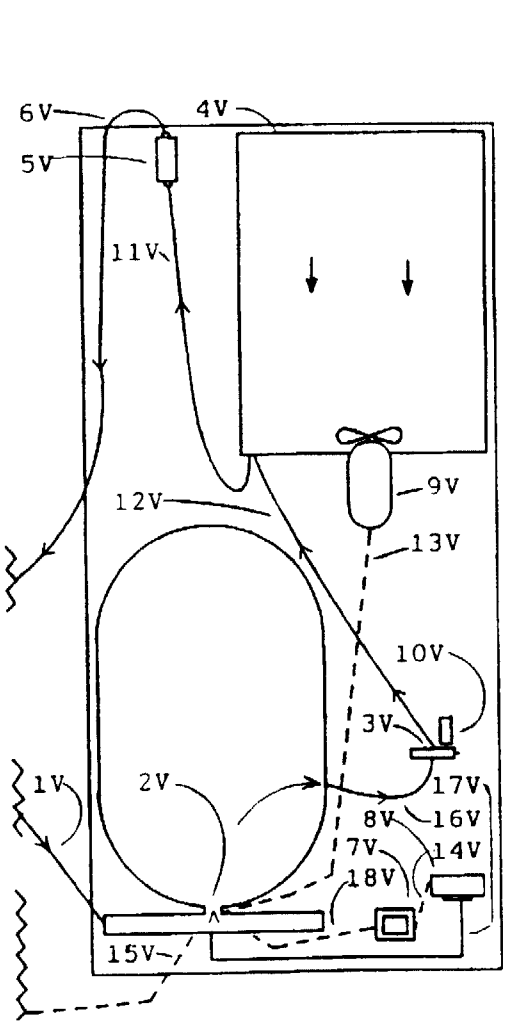
Figure 2C:
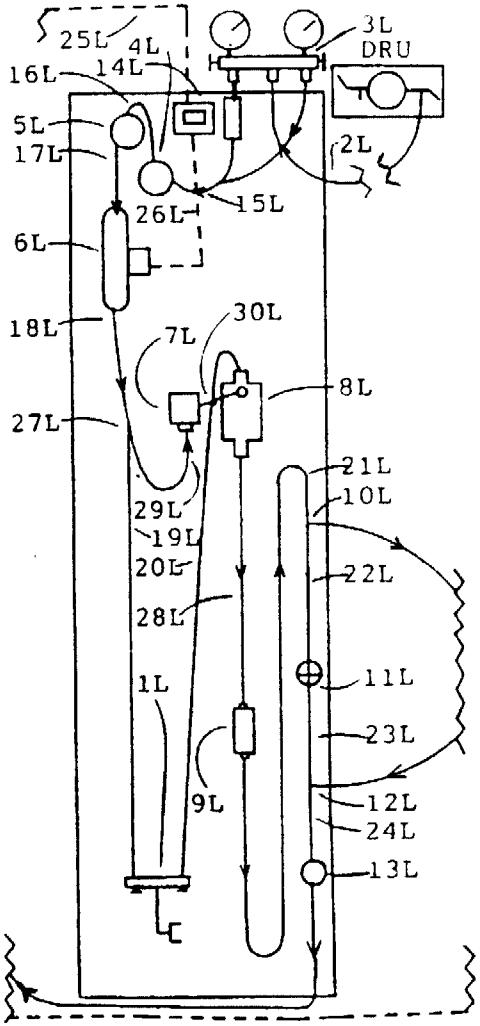

FIG. 2*c* presents numbered and lettered components itemization that diagrams top view of liquid refrigerant pump unit pump in idle phase passing vaporous refrigerant to vapor compressor condensing unit FIG. 3*c* with left and right plane refrigerant conduits and electrical cord breakaways separating figures for clarity.

FIG. 3*c* presents numbered and lettered components itemization that diagrams top view of vapor compressor condensing unit in operation to supply low pressure liquid refrigerant to recovery tank FIG. 1*c* with left plane refrigerant conduits and electrical cord breakaways separating figures for clarity.

Figure 1D:
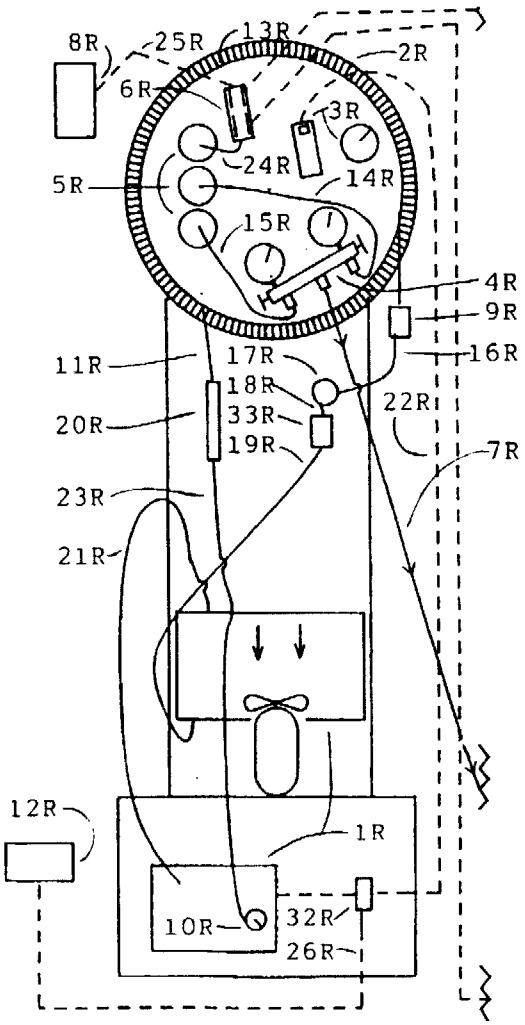
Figure 1E:
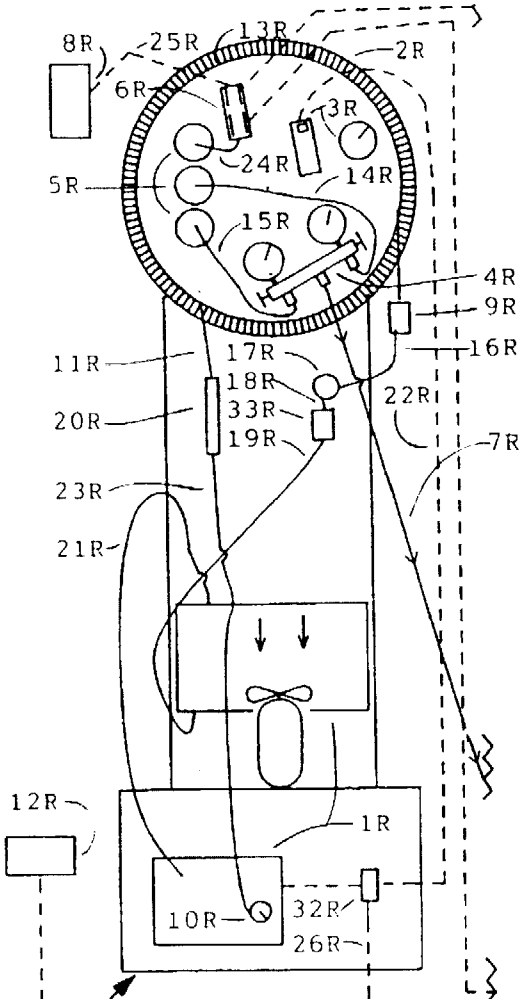

FIG. 1*d* presents numbered and lettered components itemization that diagrams top view of recovery tank freezer unit idle with tank isolated, and manifold hose under evacuation with right plane refrigerant conduit and electrical cord breakaways separating figures for clarity.

Figure 2D:
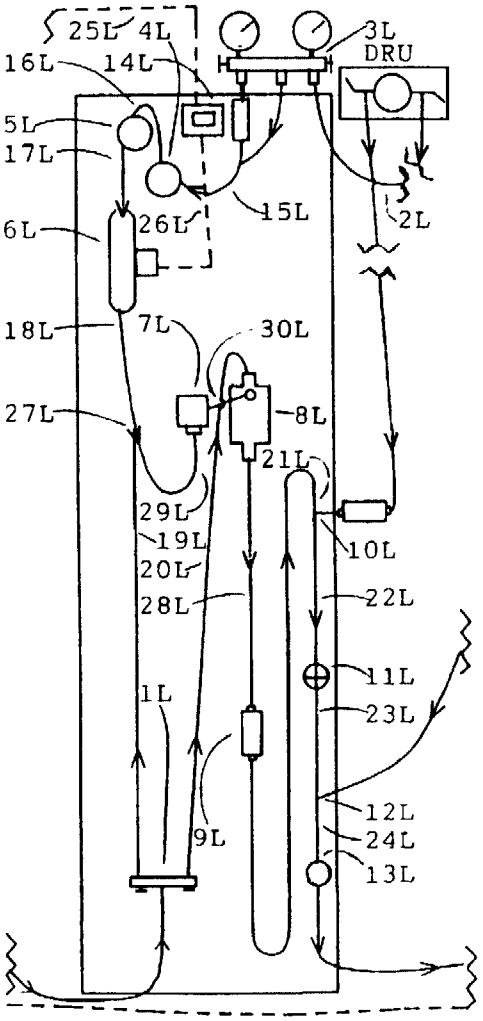
Figure 2E:
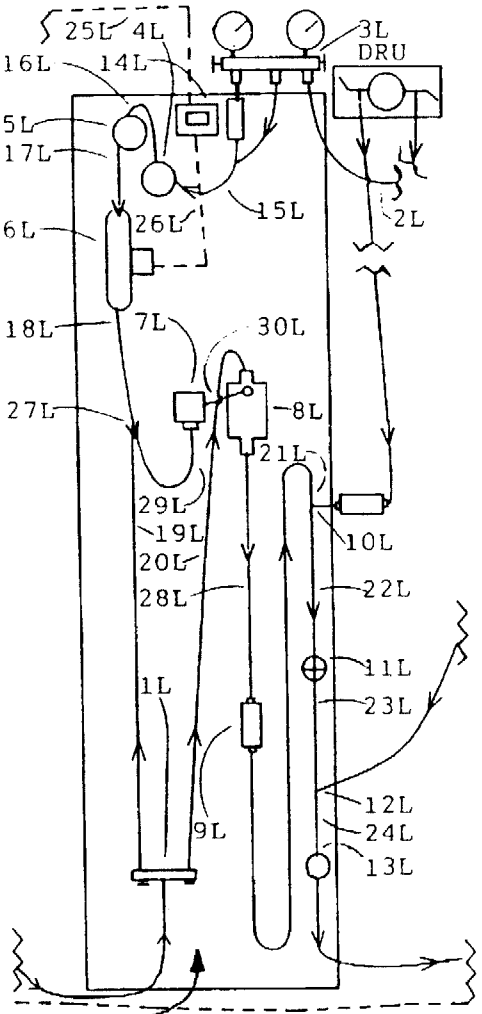

FIG. 2*d* presents numbered and lettered components itemization that diagrams top view of liquid refrigerant pump unit in post disabled refrigeration unit repair vacumn evacuation phase with left and right plane refrigerant conduits and electrical cord breakaways separating figures for clarity.

Figure 3D:
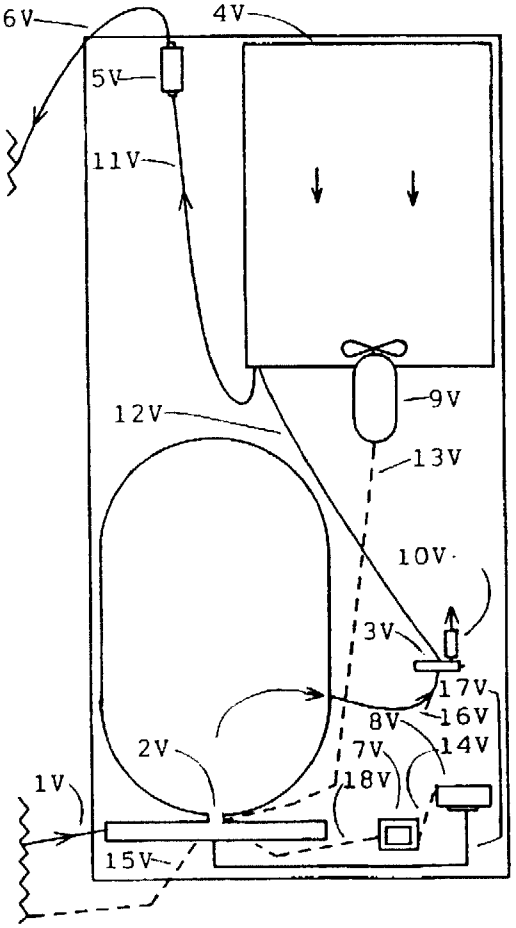
Figure 3E:
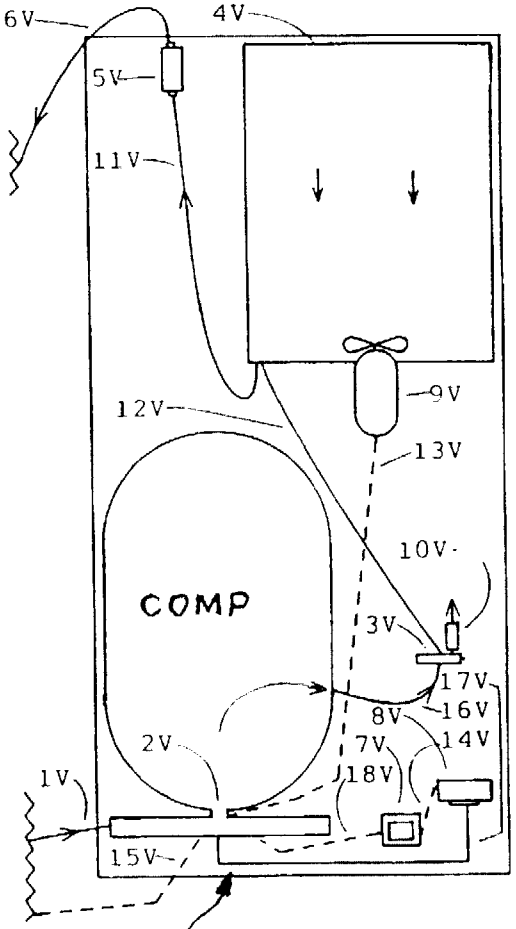

FIG. 3*d* presents numbered and lettered components itemization that diagrams top view of vapor compressor condensing unit in operation to vacumn evacuate recovery system and repaired refrigeration unit with left plane refrigerant conduits and electrical cord breakaway separating figures for clarity.

FIG. 1*e* presents numbered and lettered component itemization that diagrams top view of recovery tank freezer unit tank supplying recycled refrigerant through tank manifold conduit with right plane refrigerant conduit and electrical cord breakaway separating figures for clarity.

FIG. 2*e* presents numbered and lettered component itemization that diagrams top view of liquid refrigerant pump unit passing recycled refrigerant through to repaired refrigeration unit with left and right plane refrigerant conduits and electrical cords breakaway separating figures for clarity.

FIG. 3*e* presents numbered and lettered components itemization that diagrams top view of vapor compressor condensing unit in idle phase, and isolated from recycling procedure with left plane refrigerant conduits and electrical cord breakaway separating figures for clarity.

What is claimed follows:

1. A low pressure refrigerant recovery recycle system for repair of disabled refrigeration unit comprised of:

a recovery tank freezer unit, a liquid refrigerant pump unit, and a vapor compressor/condenser unit;

said recovery tank freezer unit comprised of a compressor, condenser, and a freezer recovery tank within an insulated freezer evaporator cabinet containing an evaporator with said recovery tank having a tank float swich controlling electricity to electric receptacle outlet, mounted to the top of said insulated freezer evaporator cabinet, that supplies power to and through electrical service cords to operate the liquid refrigerant pump unit during a liquid refrigerant recovery phase, during a vaporous refrigerant recovery phase, a pre-recovery vacuum evacuation of the freezer recovery tank, and a pre-recycle vacuum evacuation of the liquid refrigerant pump unit, the repaired disabled refrigeration unit, and the vapor compressor/condenser unit, and conduit means;

said liquid refrigerant pump unit comprised of an inlet hose for connection to the disabled refrigeration unit, a two valved guage manifold, an expansion valve, an oil separator, a liquid refrigeration pump, an adjustable expansion valve and filter dryer, each respectively connected in series and thereby defining means to draw both liquid and vaporous refrigerant via said oil separator, said inlet guage manifold and expansion valve from the disabled refrigeration unit through the inlet hose, wherein said liquid refrigerant pump pumps liquid refrigerant from said inlet hose, guage manifold, expansion valve, oil separator, sight glass, and through adjustable expansion valve to the freezer recovery tank through an inlet gauge manifold and hose means;

and said vapor compressor/condenser unit comprised of a vapor compressor/condenser unit compressor, condenser and expansion valve, for drawing vaporous refrigerant from said liquid refrigerant pump unit detoured by a closed stop valve through a bypass tee to and through said vapor compressor/condenser unit compressor, condenser and expansion valve to and through said liquid refrigerant pump unit to said freezer recovery tank; wherein recycled refrigerant liquid is admitted from a gauge manifold and hose of the recovery tank freezer unit to and through a bottom gauge manifold and hose of the liquid refrigerant pump unit to and through conduit filter dryers, a stop valve detoured bypass tee, an expansion valve to a suction service valve of the disabled refrigeration via a charging hose.

2. The apparatus of claim 1 wherin the filter dryer is a replaceable core filter drier.

3. The apparatus of claim 2 wherein the replaceable core filter drier is connected to an insulated disposable filter drier.

4. The apparatus of claim 3 wherein the insulated disposable filter drier is connected to a flow through stop valve via a conduit tee.

5. The apparatus of claim 1 wherein a flow through stop valve is connected to the filter drier.

6. The apparatus of claim 1 wherein the vapor compressor/condenser unit comprises a suction service valve inlet conduit connected to an outlet hose of the liquid refrigerant pump unit.

* * * * *